US006648700B1

(12) United States Patent
Greiner et al.

(10) Patent No.: US 6,648,700 B1
(45) Date of Patent: Nov. 18, 2003

(54) STEPPED/KEYING INTERFACE STABILIZATION ALIGNMENT MECHANISM

(75) Inventors: Robert David Greiner, Jamestown, NC (US); Yuvette Tate Peterson, High Point, NC (US); Wolfgang Hoelscher, Stokesdale, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/370,195

(22) Filed: Feb. 20, 2003

(51) Int. Cl.[7] ..... H01R 13/514
(52) U.S. Cl. ..... 439/752; 439/382
(58) Field of Search ..... 439/489, 752, 439/382, 383, 384, 385

(56) References Cited

U.S. PATENT DOCUMENTS 5,928,038 A * 7/1999 Berg et al. ..... 439/752
6,514,098 B2 * 2/2003 Marpoe et al. ..... 439/352
6,527,579 B2 * 3/2003 Sato et al. ..... 439/382

* cited by examiner

*Primary Examiner*—Tho D. Ta

(57) ABSTRACT

A stabilization alignment mechanism and method thereof for providing stalility for an electrical connector assembly, wherein the stabilization alignment mechanism comprises a cap housing having at least one stepped member protruding from an inner wall of the cap housing, wherein the stepped member comprises a first portion and a second portion; a terminal position assurance member having a guide slot configured therein for receiving the first portion of the stepped member; and a plug housing having a receiving slot configured therein for receiving the first portion of the stepped member, wherein the second portion of the stepped member sits on an outer wall of the plug housing. The plug housing slidably and stably mounts inside the cap housing. Moreover, the terminal position assurance member is a movable component within the electrical connector assembly. Furthermore, the first portion of the stepped member stably mounts between two surfaces of the plug housing.

14 Claims, 4 Drawing Sheets

STEPPED/KEYING INTERFACE STABILIZATION ALIGNMENT MECHANISM

FIELD OF THE INVENTION

The present invention generally relates to contact stabilization mechanisms used in electrical connector assemblies, and more particularly to a stepped keying/interface stabilization alignment mechanism operable in an electrical connector assembly.

BACKGROUND OF THE INVENTION

Conventional connector assemblies, as used in automobiles and other vehicles, often face several types of problems. For example, one problem involves the engagement of the connector components. Because the electrical connector assembly is mated and then sealed, it is often difficult, if not impossible, to determine if the corresponding connectors are fully engaged with one another prior to catastrophic fatigue and failure. This is of particular concern when the assembly undergoes periods of vibration, which naturally occurs whenever the vehicle is in movement, or even if it is stationary and the engine is running.

Another problem involves unrestricted and excessive movement of the contact system within the electrical assembly housings, which invariably occurs during these periods of vibration. As such, contact stabilization systems have been devised to provide a proper stabilization of internal components. However, such conventional systems do not provide for proper alignment of internal assembly components, and the conventional designs simply allow too much internal component movement to occur, thereby causing failure of the internal assembly components, and of the assembly housings themselves.

Another problem with the conventional stabilization devices is that it is difficult to determine if the internal components, themselves, have been fully seated within the connector housings, especially after the housings have been sealed. In fact, conventional stabilization mechanisms do not provide a proper manner with which to stabilize the plug housing component of the electrical connector assembly. This causes failures during vibration because the plug housing is not fully captured by the cap housing.

Terminal position assurance (TPA) members have been used to address this problem. For example, a TPA member may be a wedge-shaped structure pre-mounted to the front surface or mating interface of the housing. TPA members are commonly used on electrical connector assemblies, especially on electrical connectors used in the automotive industry. A TPA member is typically a freely movable (floatable) member that can be moved into its proper position only if all of the components in the connector are in their fully inserted position. The TPA member then pushes the internal electrical components and terminals in a direction opposite of terminal engagement, in order to fully seat them with respect to the remainder of the connector housing and then snaps into place.

Another type of TPA member may include an insertable comb. The TPA comb can only be installed after the terminals have been fully inserted into the connector body and, usually, the TPA comb engages a shoulder of the terminal to interferingly prevent withdrawal of the terminals from the housing. Unfortunately, these conventional TPA devices do not provide adequate assurance that the internal terminals and other contact components are fully seated during periods of excessive vibration. Nor do these conventional TPA devices prevent movement of the internal components of the assembly.

As such, the conventional mechanisms do not provide sufficient stabilization for the mated pair assembly. Although the conventional mechanisms use TPA members to align the two mated halves, such TPA members do not provide any benefits to combat against vibration and rocking issues. Generally, because the TPA is a floating component within the assembly, it does not help stabilize the connector system interface.

Therefore, there is a need for a novel stabilization alignment device used in electrical connector assemblies, which prevents damage to internal assembly components during periods of vibration of the assemblies, and which stabilize the connector system by ensuring that the plug and cap housings have a tight fit together.

SUMMARY OF THE INVENTION

In view of the foregoing and other problems, disadvantages, and drawbacks of the conventional contact stabilization mechanisms, various embodiments of the present invention are disclosed herein. It is an advantage of various embodiments of the present invention to provide a stepped keying/interface stabilization alignment mechanism operable in an electrical connector assembly. It is another advantage of embodiments of the present invention to provide a stabilization alignment mechanism used in electrical connector assemblies, which utilizes a freely movable terminal position assurance that provides stabilization for internal assembly components. Still another advantage of the embodiments of the present invention is to provide a stabilization alignment mechanism used in electrical connector assemblies which prevents damage to internal assembly components during vibration. Yet another advantage of embodiments of the present invention is to provide a stabilization alignment mechanism used in electrical connector assemblies which increases the stability of the interface area of the mated assembly during use while simultaneously providing different keying options and alignment ability. A further advantage of embodiments of the present invention is to reduce the number of extra elements necessary to achieve alignment, keying, and stability with all individual features.

In order to attain the advantages suggested above, there is provided, according to one aspect, a stabilization alignment mechanism providing stability for an electrical connector assembly, wherein the stabilization alignment mechanism comprises a cap housing unit having at least one stepped member protruding from an inner wall of the cap housing unit, wherein the stepped member comprises a first portion and a second portion; a terminal position assurance member having a guide slot configured therein for receiving the first portion of the stepped member; and a plug housing unit having a receiving slot configured therein for receiving the first portion of the stepped member, wherein the second portion of the stepped member sits on an outer wall of the plug housing unit. The plug housing unit is slidably and stably mounted inside the cap housing. Moreover, the terminal position assurance member is a movable component within the electrical connector assembly. Furthermore, the first portion of the stepped member is stably mounted between two surfaces of the plug housing unit.

Moreover, a method of stably aligning an electrical connector assembly is provided according to embodiments of the present invention, wherein the method comprises aligning a stepped member into an engaging position, wherein the step member outwardly protrudes from an inner wall of a cap housing, and wherein the stepped member comprises a first portion and a second portion. The second step involves urging the first portion of the stepped member into a guide slot configured in a terminal position assurance member. Next, the first portion of the stepped member is positioned into a receiving slot configured in a plug housing. Finally, the second portion of the stepped member is positioned on an outer wall of the plug housing. According to embodiments of the present invention, the plug housing slidably and stably mounts inside the cap housing. Additionally, the terminal position assurance member is a movable component within the electrical connector assembly, and the first portion of the stepped member stably mounts between two surfaces of the plug housing.

Embodiments of the present invention overcome the several disadvantages of the conventional designs, and in particular, has an advantage over conventional stabilization alignment mechanisms because a stepped keying/interface stabilization alignment mechanism operable in an electrical connector assembly is provided, and which further utilizes a freely movable terminal position assurance that provides stabilization for internal assembly components.

Another advantage of embodiments of the present invention is that it provides a stabilization alignment mechanism used in electrical connector assemblies which prevents damage to internal assembly components during vibration. Still another advantage is that it provides a stabilization alignment mechanism used in electrical connector assemblies which increases the stability of the interface area of the mated assembly during use while simultaneously providing different keying options and alignment ability. A further advantage n is that it reduces the number of extra elements necessary to achieve alignment, keying, and stability with all individual features. Additionally, a novel design is provided which fully captures the plug housing component of the electrical connector assembly within the cap housing component, thereby reducing failure during periods of vibration.

BRIEF DESCRIPTION OF THE DRAWINGS

The foregoing and other aspects and advantages will be better understood from the following detailed description of the invention with reference to the drawings, in which.

DETAILED DESCRIPTION

As previously mentioned, there is a need for a novel stabilization alignment device used in electrical connector assemblies, which prevents damage to internal assembly components during periods of vibration of the assemblies, and which stabilize the connector system by ensuring that the plug and cap housings have a tight fit together. Embodiments of the present invention provide a stepped keying/interface stabilization alignment mechanism operable in an electrical connector assembly, which utilizes a freely movable terminal position assurance that provides stabilization for internal assembly components.

Embodiments of the present invention also provide a stabilization alignment mechanism which prevents damage to internal assembly components during vibration, and which increases the stability of the interface area of the mated assembly during use while simultaneously providing different keying options and alignment ability. Also, embodiments of the present invention provide a novel design which reduces the number of extra elements necessary to achieve alignment, keying, and stability with all individual features.

Figure 1:
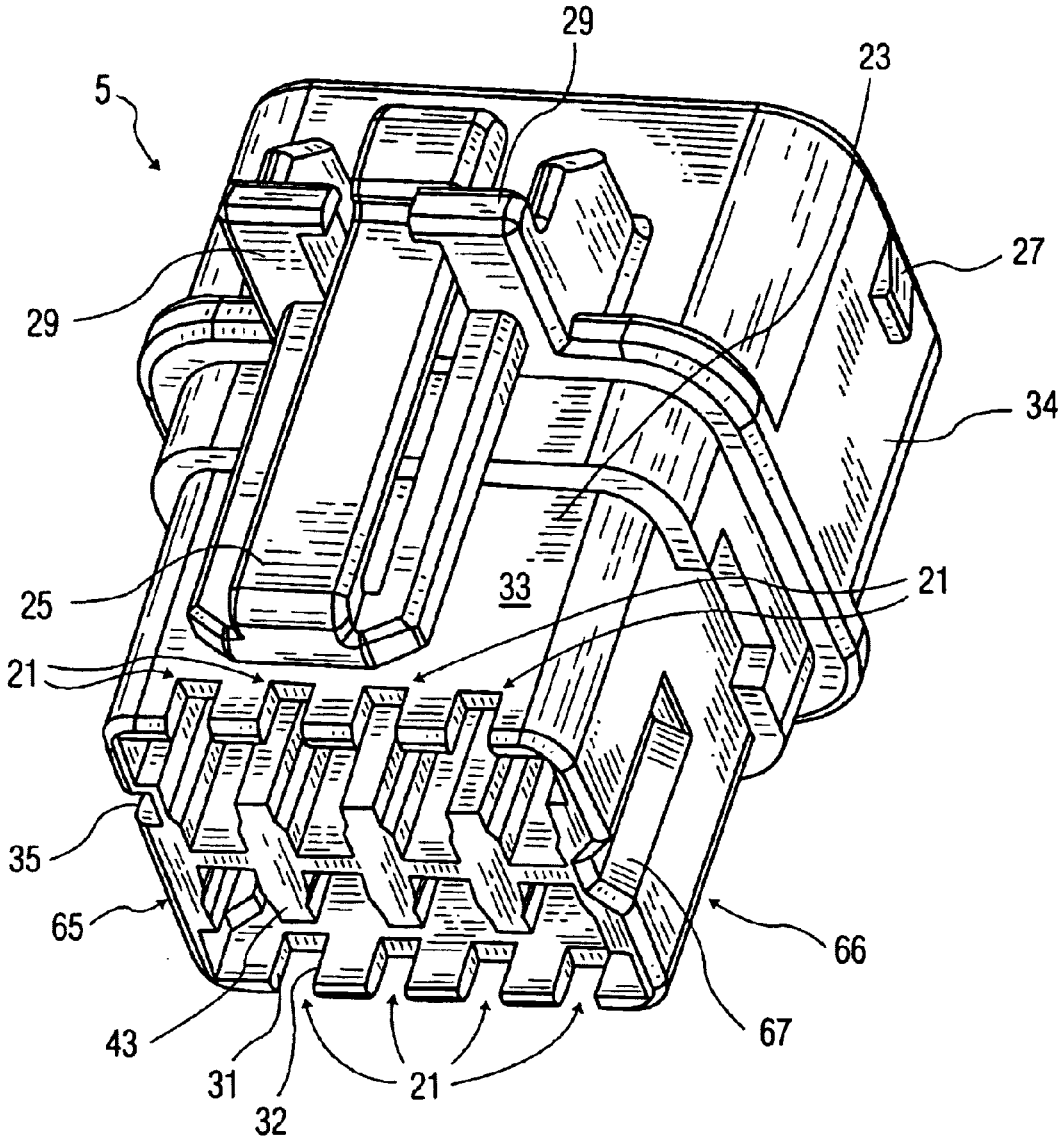
FIG. 1 is a perspective view of a stabilization alignment mechanism according to an embodiment of the present invention.

Referring now to the drawings, and more particularly to FIGS. 1 through 6, there are shown exemplary embodiments of the structures and methods according to the present invention. Generally, as illustrated in FIGS. 2–5, stepped keying/stabilization features 15 are provided in a cap housing unit 10, along the inside walls 55. The stabilization features 15 are stepped such that one portion 17 of the protrusion 15 goes through a slot in a TPA, and thereafter into a slot 21 in the plug housing component 5, as shown in FIG. 1. Portion 17 creates a stabilizing interface, which is substantially horizontal in this embodiment, as the keyed protrusion 15 is captured between two surfaces 31, 32 on the plug housing 5. The other portion 19 of the stepped key 15 sits on the outer portion 33 of the plug housing interface walls 23. Portion IA creates a stabilizing interface, which is substantially vertical in this embodiment, where the direction of the main mating latch is considered the vertical direction. Moreover, between the vertical and horizontal forces, the plug housing 5 is effectively captured inside the cap housing 10, mainly due to the stepped keys 15.

Specifically, for purposes of illustration, a stabilization alignment mechanism providing stability for an electrical connector assembly I is shown in FIGS. I through 6 comprising a generally rectangular cap housing unit 10 having at least one stepped member 15 protruding from an inner wall 55 of the cap housing unit 10, wherein the stepped member 15 comprises a generally elongated shaft portion 51 terminating with a first portion 17 and a second portion 19. The first portion 17 is a generally stepped-key member 17, which protrudes outwardly from the shaft portion 51, which is substantially perpendicular in this embodiment. The second portion 19, which has a generally beveled upper surface 60, is positioned at the top of the shaft portion 51 of the stepped member 15.

Figure 4:
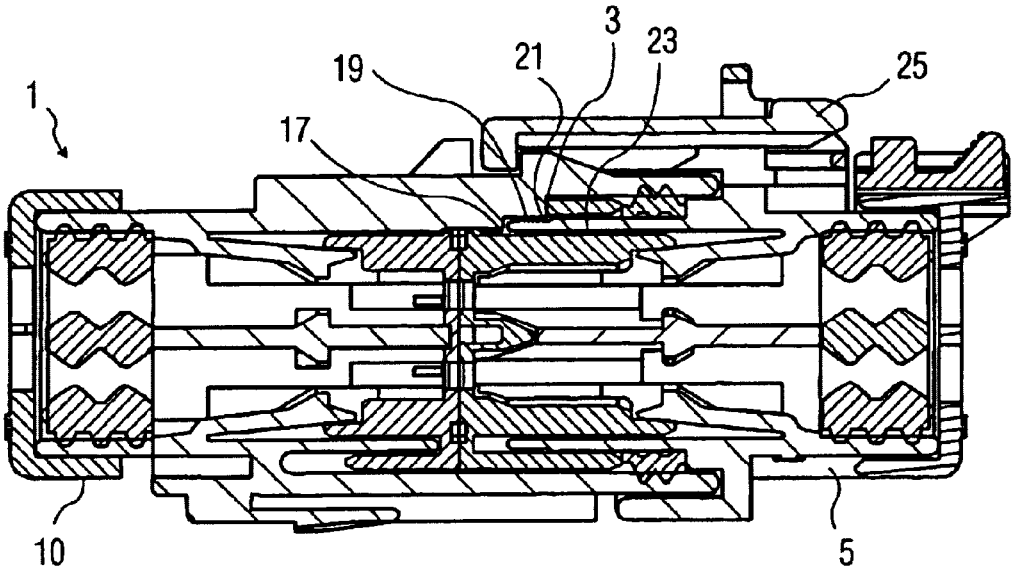
FIG. 4 is a side view of a stabilization alignment mechanism shown in a closed position.
Figure 5:
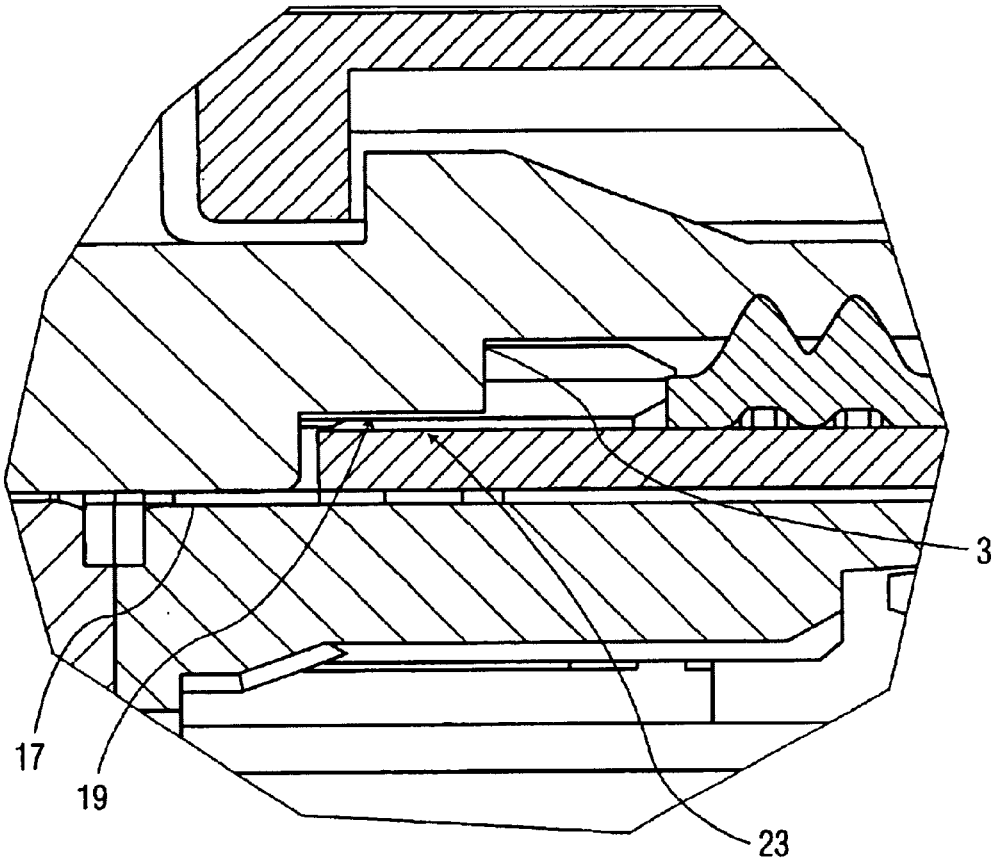
FIG. 5 is an isolated side view of the stabilization alignment mechanism shown in FIG. 4.
Figure 6:
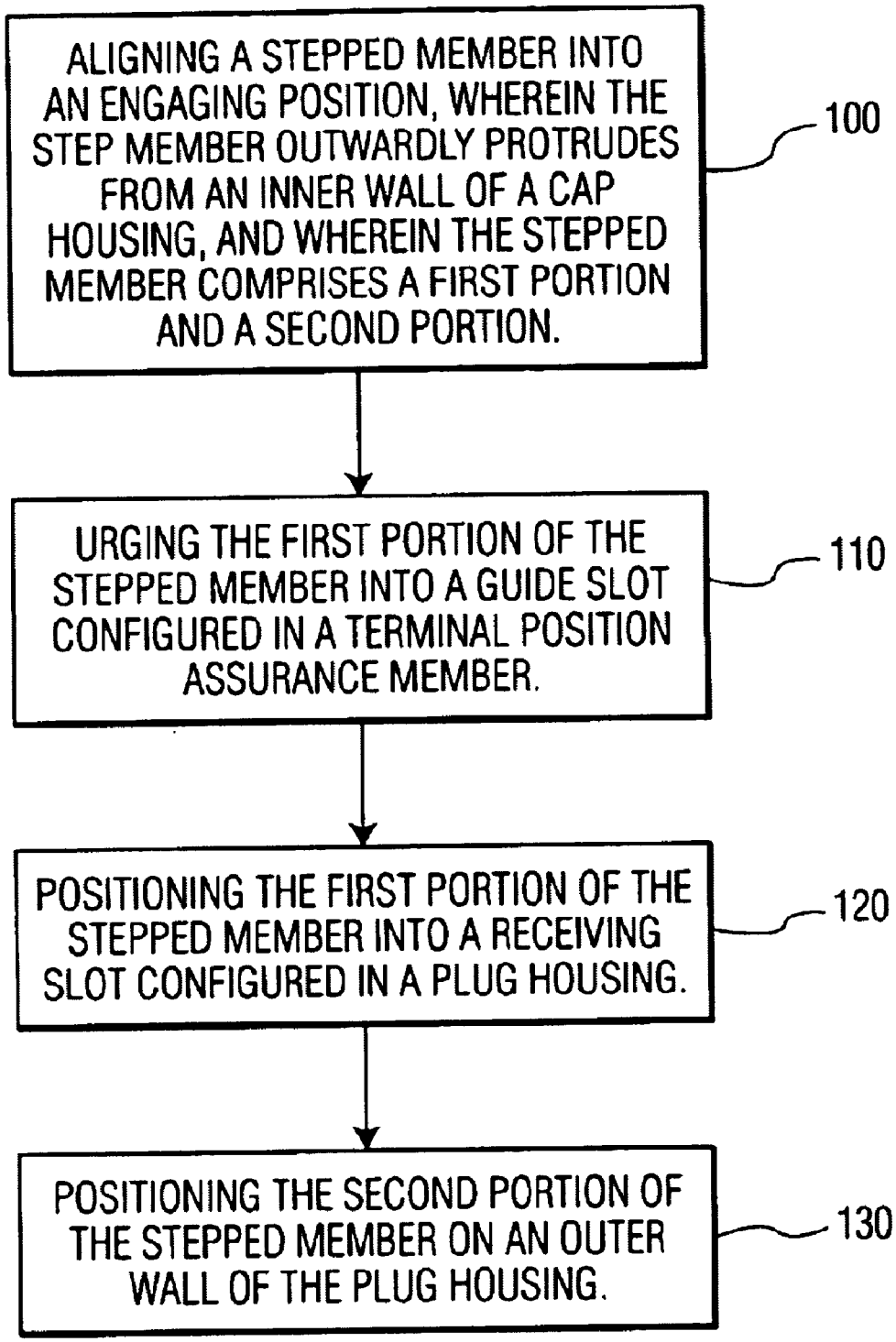
FIG. 6 is a flow diagram illustrating an exemplary method of an embodiment of the present invention.

The stabilization alignment mechanism in the present embodiment further preferably comprises a terminal position assurance member 3 having a guide slot configured therein for receiving the first portion 17 of the stepped member 15. FIG. 4 illustrates a cross section, which shows the stepped key 15 extending from the cap housing unit 10 and through the TPA and captured in a slot 21 (as shown in FIG. 1) of plug housing 5. The details of FIG. 4 may be better understood when considered in the context of FIG. 5, which shows an isolated view of the stabilization mechanism shown in FIG. 4.

As shown in FIG. 1, the mechanism preferably also includes a generally rectangular plug housing unit 5 having a receiving slot 21 configured therein for receiving the first portion 17 of the stepped member 15, wherein the second portion 19 of the stepped member 15 sits on an outer wall 23 (as shown in FIG. 1) of the plug housing unit 5. The plug housing unit 5 is slidably and stably mounted inside the cap housing unit 10. That is, the cap housing unit 10 is dimensioned and configured to receive the plug housing unit such that a stable alignment results from the mating thereof.

The terminal position assurance member preferably comprises a movable component within the electrical connector assembly 1. The first portion 17 of the stepped member 15 is preferably stably mounted between two surfaces 31, 32 of the plug housing unit 5, while the second portion 19 of the stepped member 15 is mounted along the outer surface 33 of the outer wall 23 of the plug housing unit 5.

As shown in FIG. 1, the plug housing 5 further preferably comprises a grip mounting catch 27 disposed on an outer casing 34 of the plug housing 5. Moreover, an engagement member 25 and mounting arms 29 are fixed on the outer casing 34 of the plug housing 5. Furthermore, a manifold region 43 is defined in the interface portion 66 of the plug housing 5, wherein the interface portion 66 mates with a corresponding interface portion 76 of the cap housing 10 in the manner shown in FIG. 4. The plug housing 5 in this embodiment further comprises a pair of slots 35, 67 defined in the outer wall 65 of the interface portion 66, as shown in FIG. 1.

Figure 2:
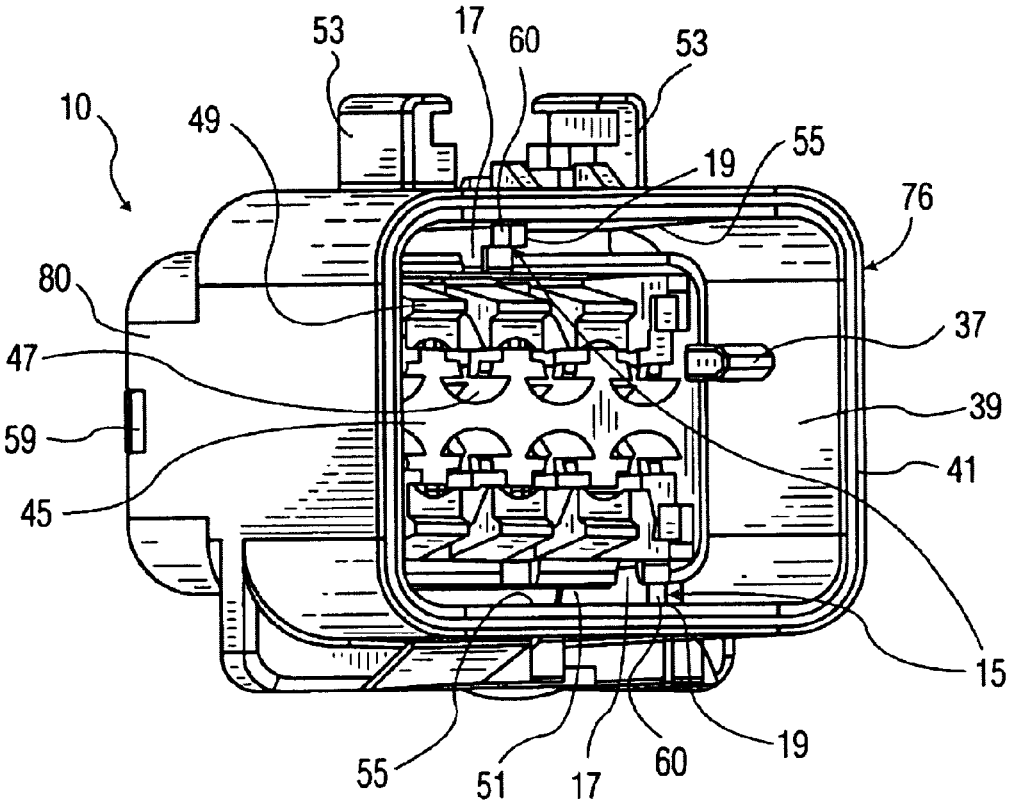
FIG. 2 is a perspective view of a stabilization alignment mechanism according to an embodiment of the present invention.
Figure 3:
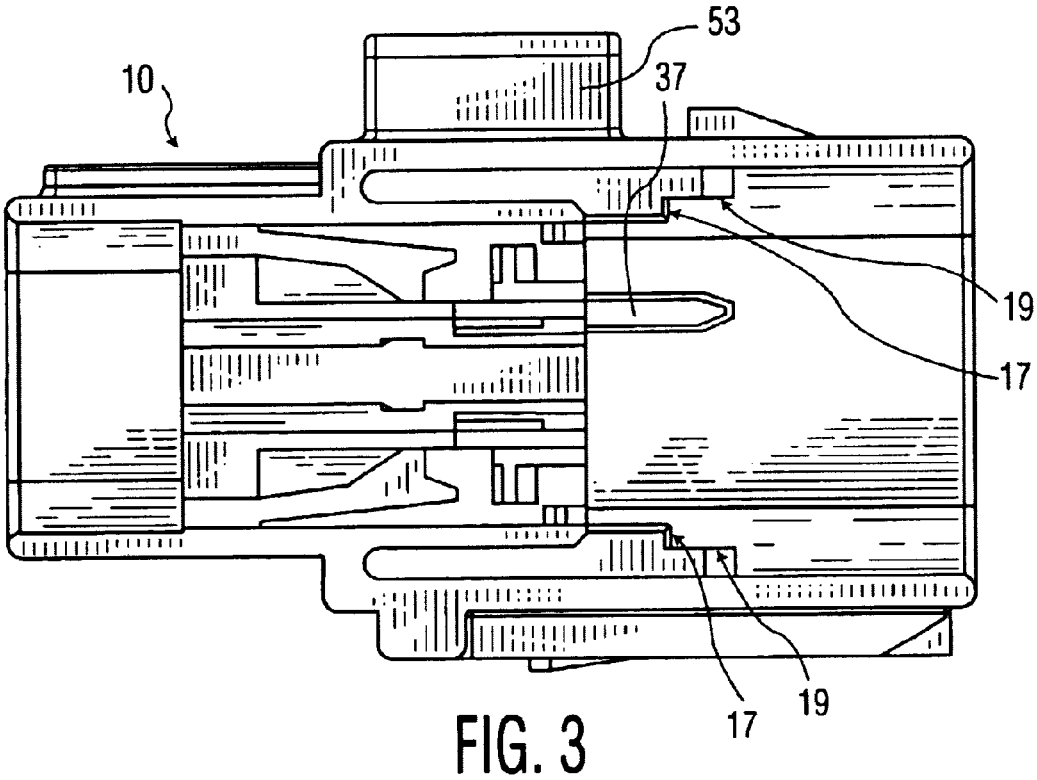
FIG. 3 is a side view of a stabilization alignment mechanism according to an embodiment of the present invention.

The cap housing unit 10, as illustrated in FIG. 1 further comprises a grip catch 59 and engagement catch 53 disposed on an outer wall 80 of the cap housing 10, wherein the engagement catch 53 is dimensioned and configured to receive the engagement member 25 of the plug housing 5, as shown in FIG. 4. The cap housing 10 includes a generally elongated inner wall 55 from which the stepped member 15 protrudes therefrom in the present embodiment. As shown in FIG. 2, generally elongated alignment member 37 protrudes outwardly from the side inner wall 39 of the cap housing 10, wherein the alignment member 37 is adapted to engage one of the slots 35, 67 of the plug housing 5. Additionally, as shown in FIG. 2, a base 45 having a plurality of generally curvilinear apertures 47 defined therein in this embodiment is configured in the cap housing unit 10, which is surrounded by wedge members 49, wherein the manifold 43, base 45, apertures 47, and wedge members 49 are operable to stably house other internal electrical components, which are not shown in FIG. 2.

In addition, a method of stably aligning an electrical connector assembly is provided according to an embodiment of the present invention. As illustrated in the flow diagram of FIG. 6, the method comprises aligning a stepped member 15 into an engaging position, wherein the step member 15 outwardly protrudes from an inner wall 55 of a cap housing 10, and wherein the stepped member 15 comprises a first portion 17 and a second portion 19, at step 100. The next step involves urging the first portion 17 of the stepped member 15 into a guide slot configured in a terminal position assurance member, at step 110. Next, the first portion 17 of the stepped member 15 is positioned 120 into a receiving slot 21 configured in a plug housing 5, at step 120. Finally, the second portion 19 of the stepped member 15 is positioned on an outer wall 23 of the plug housing 5, at step 130.

In addition, according to the present embodiment, preferably the plug housing 5 slidably and stably mounts inside the cap housing 10. Additionally, the terminal position assurance member is preferably a movable component within the electrical connector assembly 1, and the first portion 17 of the stepped member 1 stably mounts between two surfaces 31, 32 of the plug housing 5.

Embodiments of the present invention overcome the several disadvantages of conventional designs, and in particular, has an advantage over conventional stabilization alignment mechanisms because a stepped keying/interface stabilization alignment mechanism is provided that is operable in an electrical connector assembly, and which further may utilize a freely movable, terminal position assurance member that provides stabilization for internal assembly components.

Another advantage of embodiments of the present invention is that it provides a stabilization alignment mechanism used in electrical connector assemblies which prevents damage to internal assembly components during vibration. Another advantage of embodiments of the present invention is that a stabilization alignment mechanism is provided that can be used in electrical connector assemblies, which increases the stability of the interface area of the mated assembly during use while simultaneously providing different keying options and alignment ability. A further advantage of embodiments of the present invention is that the number of extra elements necessary to achieve alignment, keying, and stability with all individual features are reduced. Additionally, another advantage of embodiments of the present invention the plug housing component of the electrical connector assembly is captured within the cap housing component, thereby reducing failure during periods of vibration.

Although this invention has been described with reference to particular embodiments, it will be appreciated that many variations may be resorted to without departing from the spirit and scope of this invention as set forth in the appended claims.

What is claimed is:

1. A stabilization alignment mechanism comprising:

a cap housing having at least one stepped member protruding from an inner wall of said cap housing, wherein said stepped member comprises a first portion and a second portion;

a terminal position assurance member having a first slot configured therein for receiving said first portion of said stepped member; and a plug housing having a second slot configured therein for receiving said first portion of said stepped member, wherein said second portion of said stepped member sits on an outer wall of said plug housing.

2. The stabilization alignment mechanism of claim 1, wherein said plug housing is slidably mounted inside said cap housing.

3. The stabilization alignment mechanism of claim 1, wherein said plug housing is stably mounted inside said cap housing.

4. The stabilization alignment mechanism of claim 1, wherein said terminal position assurance member is a movable component within said stabilization alignment mechanism.

5. The stabilization alignment mechanism of claim 1, wherein said first portion of said stepped member is stably mounted between two surfaces of said plug housing.

6. A stabilization alignment mechanism providing stability for an electrical connector assembly, said stabilization alignment mechanism comprising:

a cap housing unit having at least one stepped member protruding from an inner wall of said cap housing unit, wherein said stepped member comprises a first portion and a second portion;

a terminal position assurance member having a guide slot configured therein for receiving said first portion of said stepped member; and a plug housing unit having a receiving slot configured therein for receiving said first portion of said stepped member, wherein said second portion of said stepped member sits on an outer wall of said plug housing unit, and wherein said first portion of said stepped member is stably mounted between two surfaces of said plug housing unit.

7. The stabilization alignment mechanism of claim 6, wherein said plug housing unit is slidably mounted inside said cap housing unit.

8. The stabilization alignment mechanism of claim 6, wherein said plug housing unit is stably mounted inside said cap housing unit.

9. The stabilization alignment mechanism of claim 6, wherein said terminal position assurance member is a movable component within said electrical connector assembly.

10. A method of stably aligning an electrical connector assembly, said method comprising:

aligning a stepped member into an engaging position, wherein said stepped member outwardly protrudes from an inner wall of a cap housing, and wherein said stepped member comprises a first portion and a second portion;

urging said first portion of said stepped member into a guide slot configured in a terminal position assurance member;

positioning said first portion of said stepped member into a receiving slot configured in a plug housing; and positioning said second portion of said stepped member on an outer wall of said plug housing.

11. The method of claim 10, wherein said plug housing slidably mounts inside said cap housing.

12. The method of claim 10, wherein said plug housing stably mounts inside said cap housing.

13. The method of claim 10, wherein said terminal position assurance member is a movable component within said electrical connector assembly.

14. The method of claim 10, wherein said first portion of said stepped member stably mounts between two surfaces of said housing.

* * * * *